US005950294A

United States Patent [19]

Gibbs

[11] Patent Number: 5,950,294

[45] Date of Patent: Sep. 14, 1999

[54] TOOL FOR IMMOBILIZING CAM SHAFT GEARS

[76] Inventor: Joseph L. Gibbs, 1105 Benefit Rd., Chesapeake, Va. 23322

[21] Appl. No.: 09/042,749

[22] Filed: Mar. 17, 1998

[51] Int. Cl.[6] ..... B25B 27/14

[52] U.S. Cl. ..... 29/281.5; 269/229; 269/199; 29/271; 29/276

[58] Field of Search ..... 29/281.5, 270, 29/271, 276, 888.011; 269/138, 23; 188/4 R, 2 R, 74, 36

[56] References Cited

U.S. PATENT DOCUMENTS

| | | | |
|---|---|---|---|
| 1,900,314 | 3/1933 | Strom | 29/270 |
| 3,827,685 | 8/1974 | Wennes | 269/229 |
| 4,635,372 | 1/1987 | Tande | 269/50 |
| 4,837,915 | 6/1989 | Wilms | 29/276 |
| 5,099,563 | 3/1992 | Strusch . | |
| 5,297,339 | 3/1994 | Morgenstern et al. . | |
| 5,401,011 | 3/1995 | Gatenby et al. . | |
| 5,454,153 | 10/1995 | Noel . | |
| 5,490,582 | 2/1996 | Trowbridge | 188/2 R |

*Primary Examiner*—David A. Scherbel
*Assistant Examiner*—Lee Wilson
*Attorney, Agent, or Firm*—MacMillan, Sobanski & Todd, LLC

[57] ABSTRACT

A tool which immobilizes dual camshafts of an internal combustion engine by interfering with teeth of the gears or sprockets driving the camshafts when inserted into engagement with the teeth of both gears or sprockets. The tool comprises a generally U-shaped member, wherein the sides of the U pass into and occupy valleys of the teeth. The center of the U has reliefs exposing timing marks of the engine. The tool has optional adjustment structure for adjusting length of the sides of the U and optional second adjustment structure for variably spacing the two sides of the U apart. The former adjustment structure may comprise frictionally retained, slidably disposed members, or may comprise a clamp employing a threaded fastener. In an alternative embodiment, the tool may be formed in separable components wherein two interference members are mounted on a threaded shaft. In the alternative embodiment, one interference member has teeth on each one of two lateral sides, for engaging the teeth of the gear or sprocket, and the other interference member is essentially planar. In the alternative embodiment, the three components are clamped together by a nut tightened onto the threaded shaft after the upper and lower interference members are assembled and placed in a position interfering with rotation of the gear or sprocket.

10 Claims, 3 Drawing Sheets

TOOL FOR IMMOBILIZING CAM SHAFT GEARS

BACKGROUND OF THE INVENTION

1. Field of the Invention

The present invention relates to tools for securing a work piece in a fixed position. More particularly, the invention provides a tool for immobilizing camshafts bearing drive gears against rotation by interfering with the gears.

2. Description of the Prior Art

When internal combustion engines having reciprocating pistons are disassembled for service, certain components must be correctly positioned to assure operability. Notably, camshafts must be positioned in a specific, predetermined angular or rotational position relative to the crankshaft, or opening and closing of the poppet valves will be other than to the manufacturer's specifications. Camshafts are typically marked to enable visual confirmation that they are properly oriented by notches or the like formed in their drive gears. It would be possible to disturb the original orientation of camshafts and to subsequently re-establish proper orientation prior to final assembly of the engine.

However, it may prove expedient to immobilize one or more camshafts in their appropriate positions if the work being performed does not require movement of the camshafts. A device for preventing rotation of a camshaft is shown in U.S. Pat No. 5,099,563, issued to Wolfgang Strusch on Mar. 31, 1992. The invention of Strusch essentially provides pins projecting against the camshaft itself. By contrast, the present invention is configured to interfere with the teeth of the gear or sprocket turning the camshaft by a chain or belt.

The structure of the present invention comprises two tongues projecting almost perpendicularly from a flat base. This construction is somewhat suggested by the configuration of the subject device of U.S. Pat. No. 5,297,339, issued to Todd A.

Morgenstern et al. on Mar. 29, 1994. However, dimensions and proportions of the device of Morgenstern et al. is unwieldy if not entirely unworkable in the environment of the present invention.

U.S. Pat. No. 5,401,011, issued to Alan D. Gatenby et al. on Mar. 28, 1995, shows a device suitable for immobilizing a drive belt by pinching the same as the belt engages two spaced apart pulleys. By contrast, the present invention does not engage a chain or belt, engaging instead teeth of two adjacent sprockets or gears.

U.S. Pat. No. 5,454,153, issued to Hector Noel on Oct. 3, 1995, shows a work piece holder having two pegs projecting perpendicularly from a flat base, parallel to one another and adjustably spaced apart. Despite sharing structural similarities with the novel tool, Noel's device cannot function as does the novel tool.

None of the above inventions and patents, taken either singly or in combination, is seen to describe the instant invention as claimed.

SUMMARY OF THE INVENTION

The present invention provides an uncomplicated device which is readily manually insertable into engagement with the sprockets or gears of the camshafts of a twin cam engine. In its most basic form, the invention comprises a U-shaped member having two sides and a bridging element spanning the sides. Each side of the U-shaped member is interposed between the gears such that it lodges in one valley of each gear. The device is positioned such that one side is located above a center line of each gear and the other side is located below this center line. Each gear is thus constrained against rotation by interference at two points about its circumference. Thus, in the basic embodiment, each side of the U shape forms an interference member engaging both gears, and the bottom of the U shape provides a bridging element connecting the two sides in fixed position to one another.

The basic U shape described thus far differs from a true U shape in that the device is slightly bent such that the sides do not occupy a common plane. Instead, they are slightly displaced from the common plane. This characteristic assures that any attempt to rotate either camshaft will cause the novel device to bind, thus more positively opposing rotation of the camshafts.

The basic embodiment is easily slid into place in a horizontal direction from the front of the engine. It is maintained in place by friction. In alternative embodiments, the sides of the U shape are adjustable as to length, to accommodate engines of different dimensions. After length is adjusted, screws are tightened so that the device is functionally united as a single, solid part. Optionally, the basic U shape is modified to expose the timing marks of the engine customarily stamped into the cylinder head or engine block, for ascertaining that the camshafts remain in correctly timed orientation with respect to the crankshaft.

In a further alternative embodiments, spacing apart of the sides of the U shape is adjustable. Instead of the height of the U shape being adjustable, spacing apart of the sides of the U shape is adjustable. This characteristic both adjusts for variable spacing apart of the camshaft gears, and also more positively clamps the novel device to the engine. In one form of the further alternative embodiments, the device is modified such that toothed members replace the sides of the U of the first embodiment. These toothed members are mounted on a threaded shaft which serves as the bridging element in this embodiment.

The novel device requires no disassembly of the engine, and engages the engine entirely from the front. It is not necessary to encircle the belt or chain or any component of the engine to install the novel device. Therefore, the camshafts are quickly constrained against disturbance to correct timing, and service to the engine may proceed unhindered by attention to the camshafts.

Accordingly, it is a principal object of the invention to provide a device for immobilizing the camshafts of an internal combustion engine.

It is another object of the invention that the device engage the gears or sprockets of the camshafts.

It is a further object of the invention that the device be installed from the front of the engine and that it require no disassembly of the engine when installing.

Still another object of the invention is to provide adjustability in dimensions for accommodating engines of different dimensions.

An additional object of the invention is to assure positive clamped engagement of the engine.

It is a further object of the invention to configure the device to assure binding against the gears or sprockets when any attempt is made to rotate the camshafts.

Yet another object of the invention is to expose the timing marks of the engine when the device is installed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
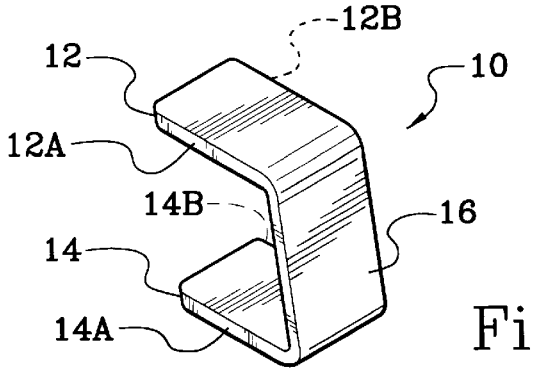
FIG. 1 is a perspective view of one embodiment of the invention.

Turning now to FIG. 1 of the drawings, novel tool 10 has an upper interference member 12 and a lower interference member 14 connected to one another in fixed, spaced apart relation by a bridging element 16. Interference members 12, 14 are dimensioned and configured to be able to slide into and occupy the valley of camshaft gears (see FIG. 3) so that the camshaft gears are constrained against rotation, or immobilized, in a manner which would disturb timing of their associated camshafts relative to the crankshaft. Interference members 12, 14 and bridging element 16 are formed as planar panels, so that tool 10 may, in this embodiment, be formed from a strip of suitable stock material.

Interference members 12, 14 are disposed perpendicularly to bridging element 16, projecting to the front side of bridging element 16. For the purposes of this discussion, the front side is that which faces the engine when tool 10 is about to be installed. Each interference member 12 or 14 has a right lateral side 12A or 14A and a left lateral side 12B or 14B arranged parallel to its corresponding right lateral side 12A or 14A. Each lateral side 12A, 12B, 14A, or 14B slidably fits into the valley 6 formed between two adjacent teeth 8 of a drive gear 2A or 2B. Each interference member 12 or 14 has a top surface and a bottom surface spaced apart by lateral sides 12A, 12B or 14A, 14B. It is not necessary that the top and bottom surfaces be continuous in the sense that they span their respective right and left lateral sides 12A, 12B or 14A, 14B in unbroken fashion.

Figure 2:
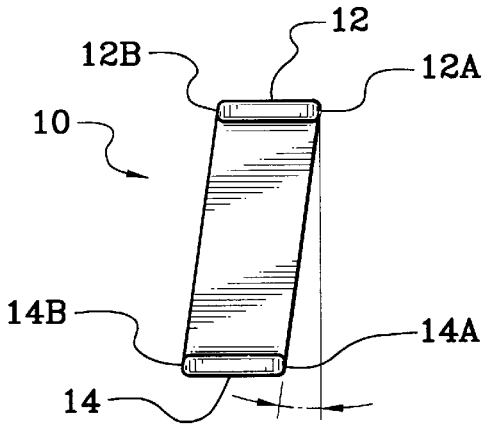
FIG. 2. is a front end elevational view of FIG. 1.

As seen in FIG. 2, tool 10 is bent such that upper interference member 12 is out of vertical registry with lower interference member 14 when interference members 12, 14 are horizontally disposed, as indicated by angle A. Of course, it would be possible that members 12, 14 be arranged other than parallel. In that case, upper and lower interference members 12, 14 would be out of vertical registry when either upper interference member 12 or lower interference member 14 were horizontally disposed.

Figure 3:
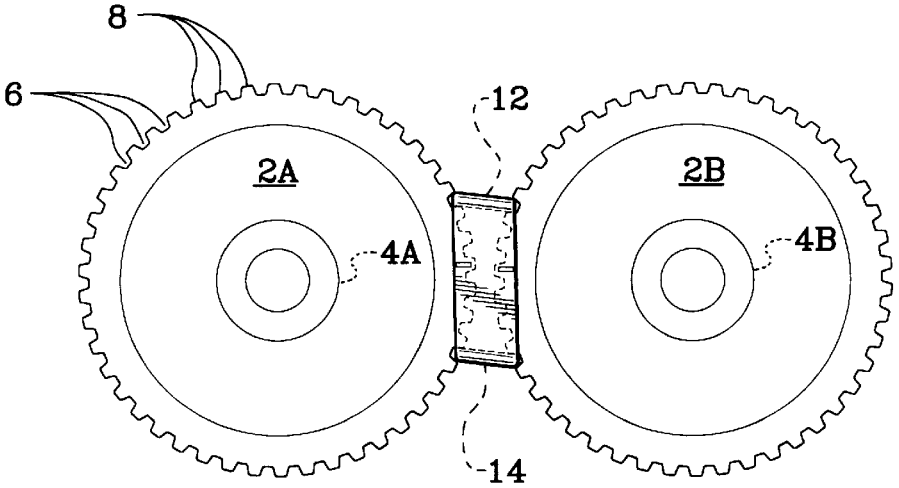
FIG. 3 is an environmental, rear end elevational view of the invention.

FIG. 3 shows tool 10 installed in the drive gears 2A, 2B of respective dual camshafts 4A, 4B. As installed, upper interference member 12 has entered and occupied one valley 6 formed between adjacent teeth 8 of each gear 2A or 2B. Each gear 2A or 2B is immobilized by virtue of interference of upper and lower interference members 12, 14 interfering with rotation thereof. Angle A enables tool 10 to achieve a configuration which promotes engagement with gears 2A, 2B, or binding, should any attempt be made to rotate gears 2A, 2B.

Figure 4:
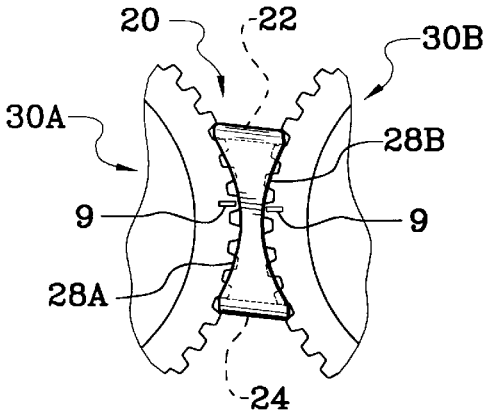
FIG. 4 is a front end elevational view of an alternative embodiment of the invention.

FIG. 4 shows a preferred embodiment of the invention wherein tool 20, which includes upper and lower interference members 22, 24 essentially duplicating interference members 12, 14 of FIG. 1, is provided with a bridging element 26 having a concave relief 28A or 28B formed at each lateral side 30A or 30B. Reliefs 28A, 28B expose timing marks 9 typically stamped into the engine (not shown in its entirety) being serviced while tool 20 is installed.

Figure 5A:
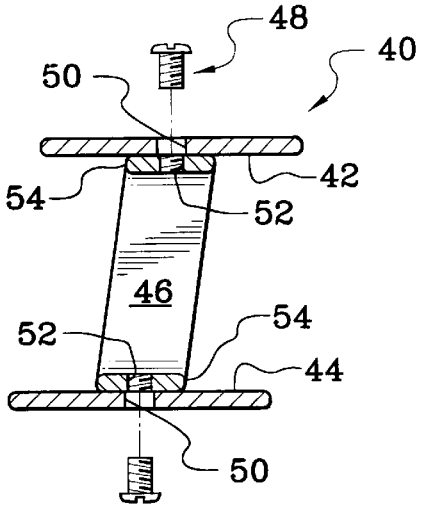
FIG. 5A is a front end elevational view of another alternative embodiment of the invention.

The embodiments described above may be usable with some engines but not with others, due to varying engine dimensions. In alternative embodiments, the invention has structure for adjusting various dimensions of the novel tool. Turning now to FIG. 5A, tool 40 is modified from the previous embodiments, having upper and lower interference members 42, 44 adjustably mounted thereto. In the embodiment of FIG. 5A, bridging element 46 is U-shaped. Each interference member 42 or 44 is clamped to bridging element 46 by a fastener, such as screw 48. Each interference member 42 or 44 has a slot 50 arranged to enable interference member 42 or 44 to be slid along bridging element 46 to a selected position, then clamped in the selected position by tightening screw 48 into a threaded hole 52. The effective length of each interference member 42 or 44 is adjusted by sliding it along the section 54 of bridging element 46 which is parallel to interference member 42 or 44.

Figure 5B:
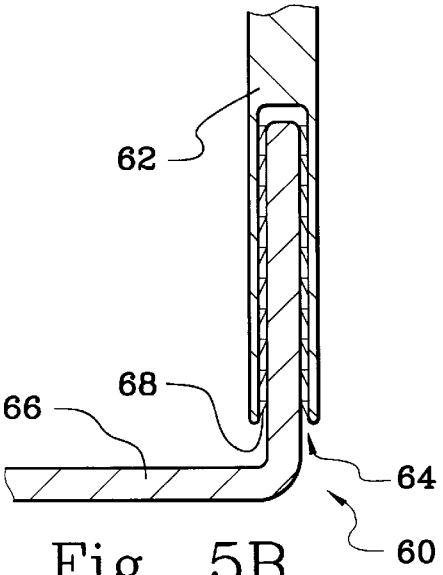
FIG. 5B is a side elevational detail view of still another alternative embodiment of the invention, the depicted component corresponding to the bottom of FIG. 5A.

Another method of clamping an adjustably positioned interfering member 60 is shown in FIG. 5B. In the embodiment of FIG. 5B, bridging element 62 has a cavity 64 which receives a section 66 of interference member 60 (not shown in its entirety). Cavity 64 is dimensioned and configured to receive interference member 60 in slidably adjustable close fit so that the latter is retained by friction, although the fit is loose enough to enable a user to move interference member 60 readily by hand. If desired, a friction enhancing material 68 is provided to assure appropriate frictional characteristics to be achieved.

Figure 6:
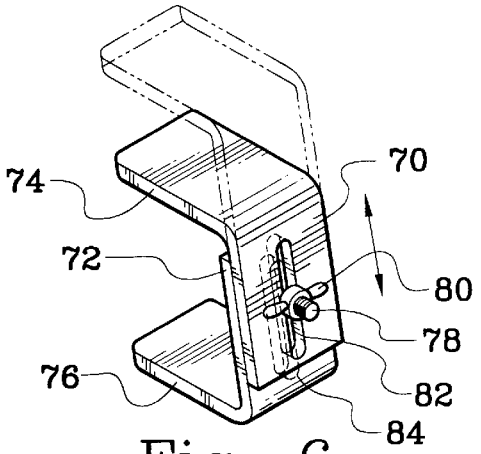
FIG. 6 is a rear elevational view of still another embodiment of the invention.

FIG. 6 shows an embodiment of the invention wherein the bridging element is formed in two separate sections 70, 72. Each section 70 or 72 is formed integrally with one interference member 74 or 76. Sections 70, 72 are disposed in overlying mutual relationship. After sections 70, 72 are repositioned such that interference members 74, 76 are spaced apart in selected proximity, sections 70, 72 are clamped firmly together and released by a suitable threaded fastener such as bolt 78 and wingnut 80. Slots 82, 84 are formed in sections 70, 72, respectively, to receive bolt 78.

Figure 7:
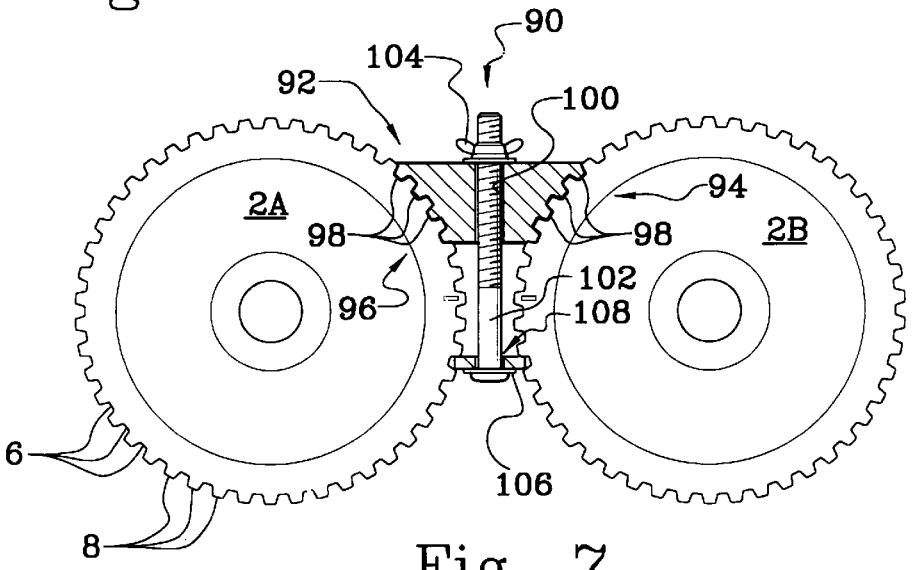
FIG. 7 is an environmental, rear elevational view of a further embodiment of the invention.
Figure 8:
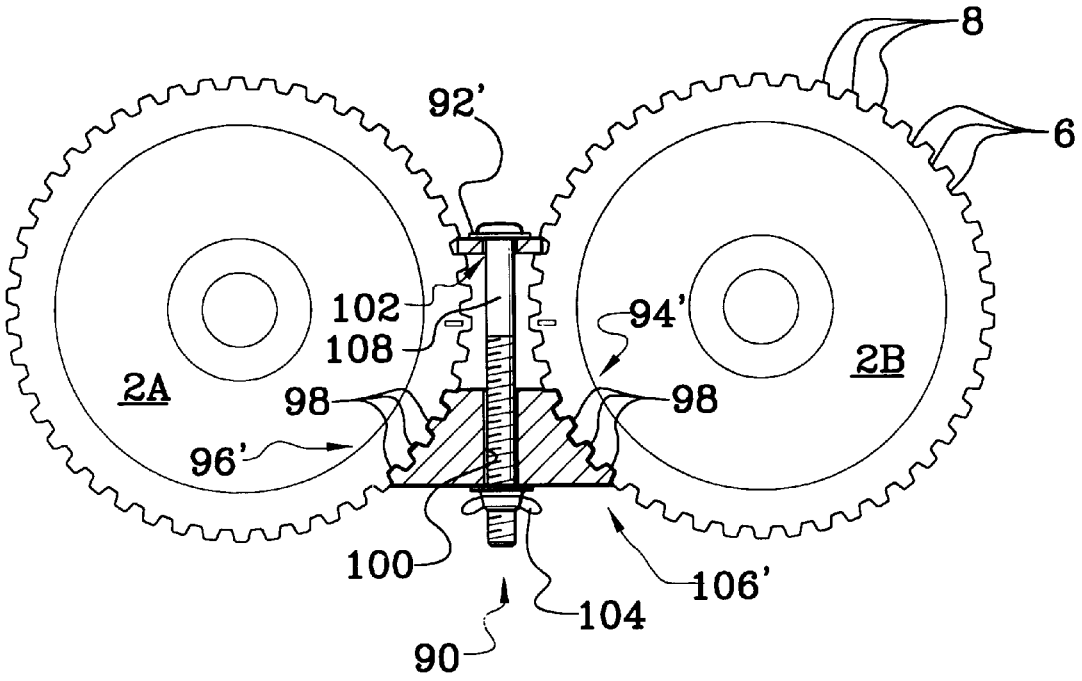
FIG. 8 is an environmental, rear elevational view of a further embodiment of the invention.

Referring now to FIG. 7, tool 90 operates in a manner generally similar to that of the previous embodiments, but has an upper interference member 92 configured to contact gear teeth 8 more extensively. Member 92 has a right lateral side 94, an opposed left lateral side 96, sides 94 and 96 bearing teeth 98, and a hole 100 disposed to slidably pass threaded shaft 102 therethrough. Shaft 102 forms the bridging element of the embodiment of FIG. 7, and includes a fastener matingly cooperating with the threads of shaft 102, such as wingnut 104 for urging member 92 against lower interference member 106 by clamping action. Member 106 may be a flat or essentially planar member having a hole 108 to slidably pass shaft 102 therethrough. It should be understood that the tool 90 may be inverted, or the lower inference member 106' may have sides 94' and 96' bearing teeth 98, as shown in FIG. 8.

It is to be understood that the present invention is not limited to the embodiments described above, but encompasses any and all embodiments within the scope of the following claims.

I claim:

1. A tool for immobilizing camshaft gears of an internal combustion engine, comprising:

an upper interference member having a right lateral side and a left lateral side disposed parallel to said right lateral side, said upper interference member dimensioned and configured to be able to slide into and occupy a valley of a camshaft gear;

a lower interference member having a right lateral side and a left lateral side disposed parallel to said right lateral side, said lower interference member dimensioned and configured to be able to slide into interfering engagement with a tooth of a camshaft gear; and a bridging element connecting said upper interference member to said lower interference member in fixed, spaced apart relation to one another in a manner such that said upper interference member is out of vertical registry with said lower interference member when said right lateral side and said left lateral side of one of said upper interference member and said lower interference member are horizontally disposed.

2. The tool according to claim 1, wherein said bridging element is formed as a planar panel, said upper interference member is formed as a planar panel and is disposed perpendicularly to said bridging element, and said lower interference member is formed as a planar panel and is disposed perpendicularly to said bridging element.

3. The tool according to claim 2, said bridging element having two lateral sides each formed to describe a concave relief, for exposing timing marks on an engine being serviced while said tool is installed on camshafts of the engine.

4. The tool according to claim 1, further comprising first adjustment means for adjusting distance by which said upper interference member is spaced apart from said lower interference member.

5. The tool according to claim 1, further comprising second adjustment means for adjusting the position of each one of said upper interference member and said lower interference member relative to said bridge member.

6. The tool according to claim 5, said bridging element comprising two separate sections disposed in overlying relationship, said second adjustment means comprising a clamp disposed selectively to clamp said two separate sections together and to release said two separate sections so that one said separate section may be repositioned with respect to the other said separate section.

7. The tool according to claim 5, said bridging element having a cavity disposed to receive at least one of said upper interference member and said lower interference member in slidably adjustable close fit wherein the received one of said upper interference member and said lower interference member can be manually moved with respect to said bridging element, said cavity having friction means for frictionally retaining the received one of said upper interference member and said lower interference member in place within said cavity when the received one of said upper interference member and said lower interference member is not being manually moved.

8. The tool according to claim 1, wherein said bridging element comprises a shaft bearing threads and a nut matingly cooperating with said threads, one of said upper interference member and said lower interference member has a first hole disposed to slidably pass said shaft therethrough, and a lateral side bearing teeth and an opposed, second lateral side bearing teeth, and the other one of said upper interference member and said lower interference member has a hole disposed to slidably pass said shaft therethrough.

9. A tool for immobilizing camshaft gears of an internal combustion engine, comprising:

an upper interference member having a right lateral side and a left lateral side disposed parallel to said right lateral side, said upper interference member dimensioned and configured to be able to slide into and occupy a valley of a camshaft gear;

a lower interference member having a right lateral side and a left lateral side disposed parallel to said right lateral side, said lower interference member dimensioned and configured to be able to slide into interfering engagement with a tooth of a camshaft gear; and a bridging element connecting said upper interference member to said lower interference member in fixed, spaced apart relation to one another in a manner such that said upper interference member is out of vertical registry with said lower interference member when said right lateral side and said left lateral side of one of said upper interference member and said lower interference member are horizontally disposed, wherein said bridging element is formed as a planar panel, said upper interference member is formed as a planar panel and is disposed perpendicularly to said bridging element, and said lower interference member is formed as a planar panel and is disposed perpendicularly to said bridging element, said bridging element having two lateral sides each formed to describe a concave relief, for exposing timing marks on an engine being serviced while said tool is installed on camshafts of the engine, said tool further comprising first adjustment means for adjusting distance by which said upper interference member is spaced apart from said lower interference member, said upper interference member and said lower interference member each having a respective length, said tool further comprising second adjustment means for adjusting the length of each one of said upper interference member and said lower interference member, said bridging element comprising two separate sections disposed in overlying relationship, said second adjustment means comprising a clamp disposed selectively to clamp said two separate sections together and to release said two separate sections so that one said separate section may be repositioned with respect to the other said separate section.

10. A tool for immobilizing camshaft gears of an internal combustion engine, comprising:

an upper interference member having a right lateral side and a left lateral side disposed parallel to said right lateral side, said upper interference member dimensioned and configured to be able to slide into and occupy a valley of a camshaft gear;

a lower interference member having a right lateral side and a left lateral side disposed parallel to said right lateral side, said lower interference member dimensioned and configured to be able to slide into interfering engagement with a tooth of a camshaft gear; and a bridging element connecting said upper interference member to said lower interference member in fixed, spaced apart relation to one another in a manner such that said upper interference member is out of vertical registry with said lower interference member when said right lateral side and said left lateral side of one of said upper interference member and said lower interference member are horizontally disposed, wherein said bridging element comprises a shaft bearing threads and a nut matingly cooperating with said threads, one of said upper interference member and said lower interference member has a first hole disposed to slidably pass said shaft therethrough, and a first lateral side bearing teeth and an opposed, second lateral side bearing teeth, and the other one of said upper interference member and said lower interference member has a second hole disposed to slidably pass said shaft therethrough.

* * * * *